US011052652B2

(12) United States Patent
Boje et al.

(10) Patent No.: US 11,052,652 B2
(45) Date of Patent: Jul. 6, 2021

(54) COVER BEARING SYSTEM

(71) Applicant: BOBST BIELEFELD GMBH, Bielefeld (DE)

(72) Inventors: Thomas Boje, Bielefeld (DE); Lorenz Landenberger, Lage (DE)

(73) Assignee: BOBST BIELEFELD GMBH, Bielefeld (DE)

( * ) Notice: Subject to any disclaimer, the term of this patent is extended or adjusted under 35 U.S.C. 154(b) by 333 days.

(21) Appl. No.: 16/302,965

(22) PCT Filed: May 24, 2017

(86) PCT No.: PCT/EP2017/025145
§ 371 (c)(1),
(2) Date: Nov. 19, 2018

(87) PCT Pub. No.: WO2017/202505
PCT Pub. Date: Nov. 30, 2017

(65) Prior Publication Data

US 2019/0143667 A1 May 16, 2019

(30) Foreign Application Priority Data

May 25, 2016 (DE) ..... 202016102778.0

(51) Int. Cl.
*B41F 13/20* (2006.01)
*B41F 27/10* (2006.01)
*B41F 13/32* (2006.01)

(52) U.S. Cl.
CPC ..... *B41F 13/20* (2013.01); *B41F 27/105* (2013.01); *B41F 13/32* (2013.01); *B41P 2217/15* (2013.01); *B41P 2227/21* (2013.01)

(58) Field of Classification Search
None
See application file for complete search history.

(56) References Cited

U.S. PATENT DOCUMENTS 2,009,141 A * 7/1935 Lippitt ..... D04B 7/00 66/64
2,103,812 A * 12/1937 Ericksson ..... B41F 13/32 101/152

(Continued)

FOREIGN PATENT DOCUMENTS

EP 2 730 410 A1 5/2014
EP 2 759 370 A1 7/2014

(Continued)

OTHER PUBLICATIONS

International Search Report issued in related PCT/EP2017/025145 dated Aug. 25, 2017 and dated Sep. 5, 2017 (3 pages).

*Primary Examiner* — Jill E Culler
(74) *Attorney, Agent, or Firm* — Bookoff McAndrews, PLLC

(57) ABSTRACT

The invention is about a valve system to grip a sleeve over a mandrel in a press, in particular on how the gripper is brought toward and away from the mandrel and sleeve assembly. The gripper is disengaged from the sleeve, following first a straight path and then a helicoidal path, thanks to an ad-hoc slot machined on an axle. This allows to disengage the gripper and set it out of the way for handling the sleeve, with a single motor and a single instruction.

11 Claims, 2 Drawing Sheets

(56) References Cited

U.S. PATENT DOCUMENTS

Figure 1:
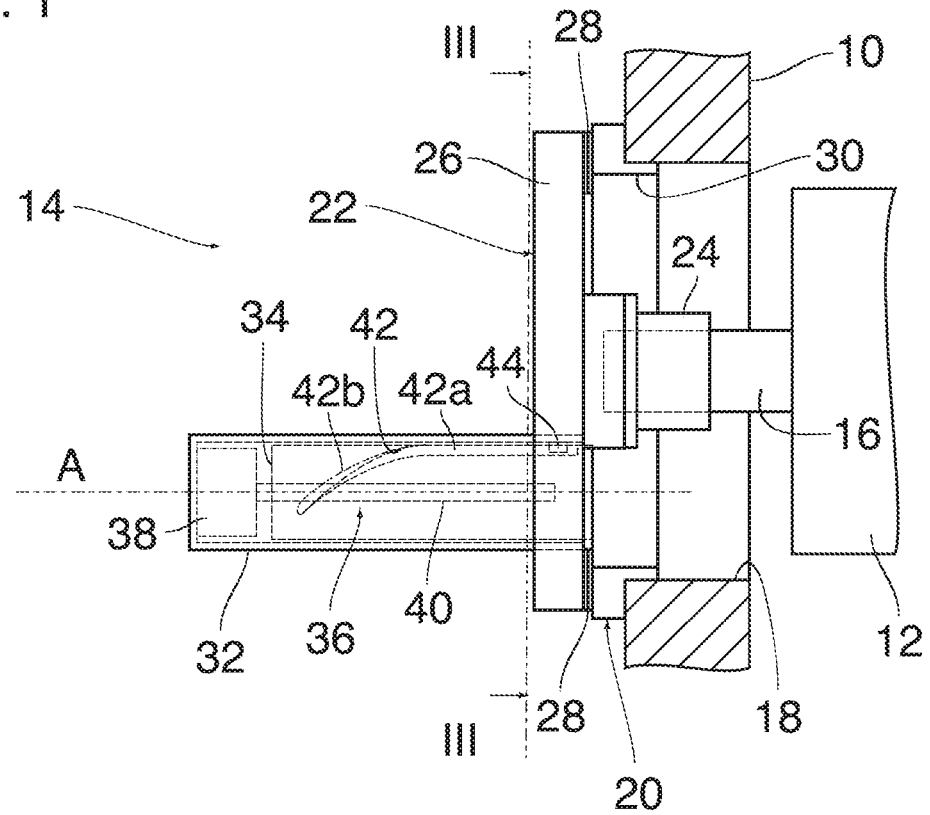

| | | | | |
|---|---|---|---|---|
| 2,402,660 | A * | 6/1946 | O'Grady | G03B 27/73<br>355/37 |
| 3,792,658 | A * | 2/1974 | Shore | B41F 13/20<br>101/247 |
| 5,127,746 | A * | 7/1992 | Rogge | B41F 13/20<br>384/24 |
| 5,241,905 | A | 9/1993 | Guaraldi et al. | |
| 6,095,365 | A * | 8/2000 | Yielding | B65D 90/10<br>105/377.07 |
| 6,796,238 | B2 * | 9/2004 | Goldburt | B41F 13/20<br>101/218 |
| 2010/0313775 | A1 * | 12/2010 | Whitelaw | B41F 13/14<br>101/248 |

FOREIGN PATENT DOCUMENTS

| | | | |
|---|---|---|---|
| GB | 2 329 151 | A | 3/1999 |
| JP | H07 214447 | A | 8/1995 |
| WO | WO 2009/074295 | A1 | 6/2009 |

* cited by examiner

COVER BEARING SYSTEM

CROSS-REFERENCE TO RELATED APPLICATION(S)

This application is a National Stage under 35 U.S.C. § 371 of International Application No. PCT/EP2017/025145, filed on May 24, 2017, which claims priority to German Patent Application No. 20 2016 102 778.0, filed on May 25, 2016, the contents of all of which are incorporated by reference in their entirety.

The invention relates to a cover bearing system for one end of a sleeve supported in a machine frame, with a bearing block, held on the machine frame, which forms a removal opening for the sleeve, a cover head that forms a bearing for the end of the sleeve and is displace-ably supported on the bearing block in the axial direction of the sleeve, so as to be able to swivel about said axis of the sleeve and extending parallel to said axis, and an actuator system for moving the cover head.

A cover bearing system of this type is described, for example, in WO 2009/074295 A1.

In some rotary printing machines, interchangeable sleeves, such as printing cylinders, screen sleeves and the like, are each pushed onto a carrier bar which protrudes like a cantilever from one side of the mesh frame and on the free end is mounted in a cover bearing system of the type considered here, so that the cover bearing system indirectly also forms a bearing for the sleeve. When the sleeve should be replaced, the cover head of the cover bearing system can be pulled off axially from the carrier rod and then swiveled to the side so that the sleeve can be pulled off the carrier rod. The movements of the cover head can be automated using the actuator system.

The object of the invention is to create a cover bearing system with a simplified actuator system.

This object is achieved according to the invention by the fact that the actuator system has an actuator for the axial movement of the cover head, such that the bearing block and the cover head are engaged with one another by means of a hollow cylinder and a cylinder body displaceable therein, one of which has a guiding contour and the other a body guided by the guiding contour, and that the guiding contour extends linearly in a first section in axial direction and in a second section helically around the axis of the cylinder body.

The linear movement of the cover head generated by the actuator is converted by the helically extending section of the guiding contour into a swiveling movement that is superimposed on the axial linear movement, so that no additional actuator is needed for swiveling the cover head.

Advantageous embodiments and further developments of the invention are given in the subordinate claims.

In the following, an exemplary embodiment is explained in more detail with reference to the drawing.

Figure 2:
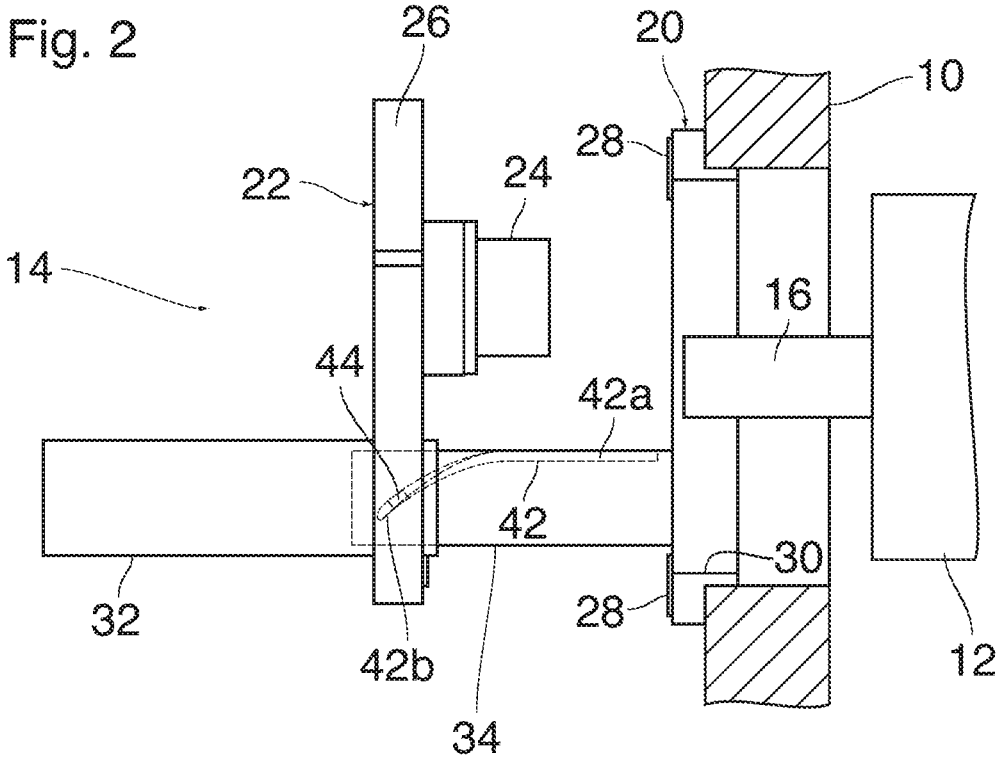
Figure 3:
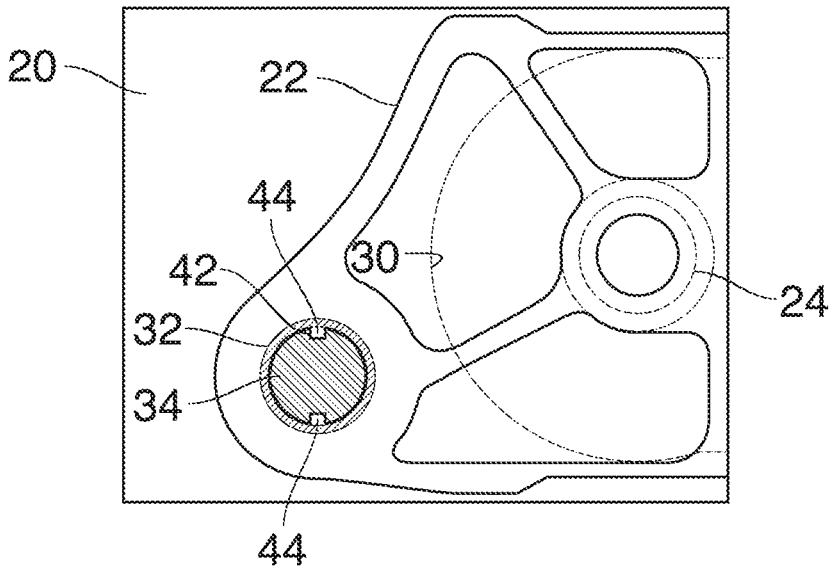

Shown are:

FIG. 1 a view of a cover bearing system and an end of a sleeve supported therein;

FIG. 2 the cover bearing system according to FIG. 1 in a position allowing the removal of the sleeve;

FIG. 3 a sectional view taken along the line III-III in FIG. 1; and

Figure 4:
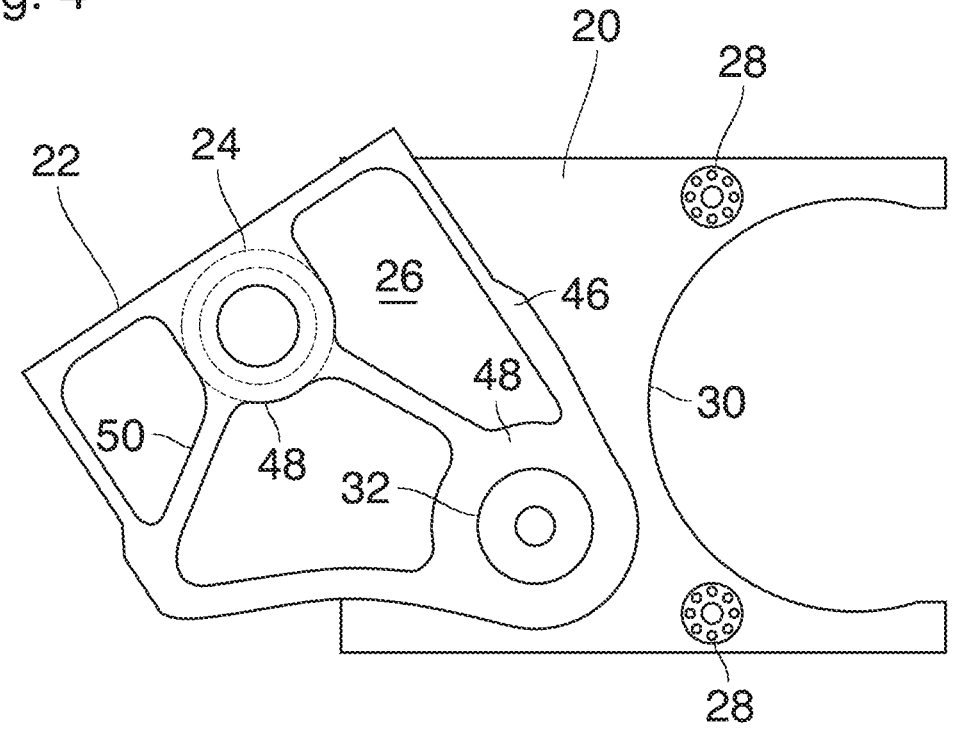

FIG. 4 a front view of the cover bearing system in the open state according to FIG. 2.

In FIG. 1, a section of a part of a sidewall of a machine frame 10 of a rotary printing machine is shown. A sleeve 12 of the printing machine, for example a printing cylinder, is mounted in the machine frame in a rotatable manner by means of a cover bearing system 14. In this example, the sleeve 12 is axially pushed onto a carrier rod 16 that protrudes in a cantilever-like manner from the side of the machine frame 10—not shown in FIG. 1—and the free end of which is mounted in the cover bearing system 14 so that the radial forces acting on the sleeve 12 can be introduced over the carrier rod 16 into the cover bearing system 14. The sidewall of the machine frame 10 shown in FIG. 1 has an opening 18 in which a bearing block 20 of the cover bearing system 14 is held on the outside.

The cover bearing system 14 also has a cover head 22 that forms a bearing 24 for the end of the carrier rod 16. The bearing 24 is fixedly mounted on a disc-shaped base body 26 of the cover head 22 that, in the state shown in FIG. 1, rests against the bearing block on the outside and is fixed to the bearing block by means of neutral-point tightening devices 28. Such neutral-point tightening devices are known to a person skilled in the art and are described, for example, in EP 2 759 370 A1.

When the sleeve 12 should be replaced, the cover head 22 can be removed from the bearing block 20 axially, i.e. in the axial direction of the carrier rod 16 and the sleeve 12, and then swiveled to the side so that the sleeve 12 can be removed axially from the carrier rod 16 and pulled out of the machine frame through the opening 18 and a removal opening 30 of the bearing block. The axially remote and swiveled position of the cover head 22 is shown in FIG. 2.

The cover head 22 and the bearing block 20 are in engagement with one another via a hollow cylinder 32 firmly attached to the base body 26 of the cover head and a cylinder body 34 firmly attached to the bearing block 20. The hollow cylinder 32 is displaceable coaxially on the cylinder body 34 and is rotatable about this cylinder body so that the common axis of the hollow cylinder 32 and the cylinder body 34 defines a swivel axis A for the swivel movement of the cover head 22 relative to the bearing block 20.

As shown in FIG. 1, the hollow cylinder 32 also accommodates an actuator 36, in the form of a linear drive, which drives the hollow cylinder 32 to move in the direction of the swivel axis A on the cylinder body 34. In the shown example, the actuator 36 has a motor 38 and a screw 40. The motor 38, for example a pneumatic rotary piston motor, is accommodated in an end section of the hollow cylinder 32 outside the cylinder body 34 and drives a spindle, of the screw 40, which extends coaxially through the cylinder body 34 and generates the axial movement of the hollow cylinder 32 relative to the cylinder body 34.

As can be seen in the sectional view in FIG. 3, the cylinder body 34 has a guiding contour 42, in its circumferential surface, which is formed here by two guide grooves that are diametrically opposite one another and predominantly extend in the longitudinal direction of the cylinder body. Follower bodies 44, engage into these guide grooves, which protrude from the inner circumferential surface of the hollow cylinder 32 behind the cutting plane in FIG. 3. For the sake of clarity, FIG. 1 shows only one of the two guide grooves of the guiding contour 42 and the follower body 44 engaged in this groove. In a first section 42*a* directly adjacent to the bearing block 20, the grooves of the guiding contour 42 extend in a straight line in axial direction, while they extend helically around the swivel axis A in a further outwardly located second section 42*b*. In FIG. 1, the follower bodies 44 lie on the right end of the hollow cylinder 32, at the same level as the base body 26 of the cover head.

When the screw 40 is rotated by the motor 38, the engagement of the follower bodies 44 in the grooves of the guiding contour 42 forms a rotational lock for the hollow cylinder 32 so that only the screw rotated by the motor 38 rotates and the cover head 22 moves from the position shown in FIG. 1 in the direction towards the position shown in FIG. 2, while the follower bodies 44 slide through the grooves of the guiding contour 42. When the follower bodies 44 reach the helical sections 42*b* of the guiding contour, the swiveling movement around the swivel axis A is superimposed on the axial movement of the cover head 22 due to the helical characteristic of the grooves. However, this swivel movement only begins when the bearing 24 has already emerged from the removal opening 30 of the bearing block 20.

FIG. 4 shows the fully deployed position of the cover head 22. It can be seen, in this position, that the bearing opening 30 is completely open so that the sleeve 12 can be removed.

As can be seen in FIG. 4, the plate-shaped base body 26 of the cover head 22 has a reinforced outer peripheral edge 46 and, around the bearing 24 and the hollow cylinder 32, reinforced hub regions 48 that are connected to one another by spokes 50 and to the peripheral edge 46.

The neutral-point tightening devices 28 can be arranged adjustably on the bearing block 20, can be preloaded in a known manner by springs into the clamping position, and are pneumatically released by means of compressed air when the cover head 22 should be removed from the bearing block 20. The pneumatic actuation of the neutral-point tightening device 28 and the pneumatic drive of the motor 38 enable the cover bearing system 14 to be used also in the explosion-protected area of a printing press.

The invention claimed is:

1. A cover bearing system for one end of a sleeve that is supported in a replaceable manner in a machine frame, the cover bearing system comprising:

a bearing block held on the machine frame, the bearing block forming a removal opening for the sleeve in an axial direction of an axis the sleeve;

a cover head that forms a bearing for the end of the sleeve, the cover head being displaceable the axial direction of the sleeve and displaceable about a swivel axis parallel to the axis of the sleeve and offset from the axis of the sleeve; and an actuator system configured to displace the cover head in the axial direction and about the swivel axis, the actuator system including an actuator, wherein the bearing block and the cover head are engaged via a hollow cylinder and a cylinder body displaceable in the hollow cylinder, a first one of the hollow cylinder and the cylinder body has a guiding contour and a second one of the hollow cylinder and the cylinder body has a follower body configured to be guided along the guiding contour, the guiding contour extends in a first section linearly in the axial direction and in a second section helically about the axis of the cylinder body.

2. The cover bearing system of claim 1, wherein the cover head includes a plate-shaped base body, the plate-shaped base body rests against the bearing block in an operating position and is configured to be fixed in a releasable manner on the bearing block by means of clamping means.

3. The cover bearing system of claim 1, wherein the hollow cylinder is arranged rigidly on the cover head and the cylinder body is arranged rigidly on the bearing block.

4. The cover bearing system of claim 1, wherein the guiding contour is formed by at least one groove and the follower body is formed by a projection engaged in the at least one groove.

5. The cover bearing system of claim 4, wherein the guiding contour is formed by two mutually diametrically opposite grooves.

6. The cover bearing system of claim 4, wherein the at least one groove forming the guiding contour is formed in an outer peripheral surface of the cylinder body, and the follower body protrudes from an inner peripheral surface of the hollow cylinder.

7. The cover bearing system of claim 1, wherein the actuator has a screw extending coaxially to the cylinder body and the hollow cylinder and has a motor driving the screw.

8. The cover bearing system of claim 7, wherein the motor is a pneumatic motor.

9. The cover bearing system of claim 7, wherein the motor is housed in an end section of the hollow cylinder.

10. The cover bearing system of claim 1, wherein the removal opening formed by the bearing block is a hole in the bearing block that allows for the sleeve to be removed axially through the hole in the axial direction.

11. The cover bearing system of claim 1, wherein the actuator displaces the cover head relative to the bearing block in the axial direction.

* * * * *